US012460547B2

(12) United States Patent
Almoukdad

(10) Patent No.: US 12,460,547 B2
(45) Date of Patent: Nov. 4, 2025

(54) OPERATING ENGINE

(71) Applicant: Almouthana Almoukdad, Dillingen (DE)

(72) Inventor: Almouthana Almoukdad, Dillingen (DE)

(73) Assignee: Almouthana Almoukdad, Dillingen (DE)

( * ) Notice: Subject to any disclaimer, the term of this patent is extended or adjusted under 35 U.S.C. 154(b) by 0 days.

(21) Appl. No.: 18/712,813

(22) PCT Filed: Nov. 12, 2022

(86) PCT No.: PCT/DE2022/000112
§ 371 (c)(1),
(2) Date: May 23, 2024

(87) PCT Pub. No.: WO2023/093927
PCT Pub. Date: Jun. 1, 2023

(65) Prior Publication Data

US 2025/0020060 A1 Jan. 16, 2025

(51) Int. Cl.
*F01B 25/10* (2006.01)
*F01B 1/02* (2006.01)

(52) U.S. Cl.
CPC ..... *F01B 25/10* (2013.01); *F01B 1/02* (2013.01)

(58) Field of Classification Search
CPC .. F01B 25/10; F01B 1/02; F01B 17/02; F01C 31/18
See application file for complete search history.

(56) References Cited

U.S. PATENT DOCUMENTS 1,933,002 A * 10/1933 Beyer ..... F02B 25/00 123/73 FA
3,358,656 A * 12/1967 Panhard ..... F02B 71/02 123/61 R
2014/0318363 A1* 10/2014 Bennett ..... F15B 13/027 417/559

* cited by examiner

*Primary Examiner* — Syed O Hasan
(74) *Attorney, Agent, or Firm* — Daniel C. Pierron; Widerman Malek, PL

(57) ABSTRACT

The present invention relates to a working engine that comprises a working volume or plurality of working volumes. The working volume(s) are each assigned one or more inlet valves and one or more outlet valves. The inlet valve(s) are connected to a supply line arrangement that supplies a medium. The inlet valve(s) are arranged so that when an inlet valve is open, the medium is supplied to the working volume assigned to the inlet valve. The outlet valve(s) are connected to a discharge line arrangement. In the working phase of increasing the working volume(s), the inlet valve(s) associated with the working volume(s) are open and the outlet valve(s) associated with the working volume(s) are closed. In the working phase of reducing the working volume(s), the outlet valve(s) associated with the working volume(s) are open and the inlet valve(s) associated with the working volume(s) are closed.

2 Claims, 7 Drawing Sheets

OPERATING ENGINE

RELATED APPLICATIONS

This application is a national phase application of and claims priority under 35 U.S.C. § 371 of PCT Application Serial No. PCT/DE2022/000112 filed on Nov. 12, 2022 and titled WORKING ENGINE, which in turn is an international application of and claims priority under PCT Chapter 1 Article 8 of German Patent Application Serial No. DE102021130933 filed on Nov. 25, 2021 and titled ARBEITSKRAFTMASCHINE. The contents of these applications are incorporated herein by reference except for where they conflict with the content herein.

The present invention relates to an operating engine according to the general term of claim 1.

SUMMARY OF THE INVENTION

The fundamental design of this type of operating engine is known as a reciprocating machine. The mode of action of these known operating engines is based on a fuel-air mixture being ignited at some point (at the beginning of a work cycle). The drive energy in the operating engine results from the energy that is released in the combustion of the fuel-air mixture. The reciprocating machines are known as 2-stroke or 4-stroke operating engines. The rotary piston engines are known as Wankel engines.

This means that the operating engine has one or several work volumes. The work volume or work volumes of the operating engine are allocated one or several inlet valves each as well as one or several outlet valves.

The one or several inlet valves are arranged in such a way that they are connected to a supply line arrangement, into which a pressurized medium is supplied. The one or several inlet valves are also arranged in such a way that the pressurized medium is fed to the respective work volume that is allocated to the respective inlet valve when the inlet valve is open.

The one or several outlet valves are connected to a discharge line arrangement, through which the medium is discharged. The one or several outlet valves are also arranged in such a way that the medium is fed away through the discharge line arrangement from the work volume allocated to the respective outlet valve.

The following describes the functioning of an operating engine based on the example of a 4-stroke operating engine with a reciprocating piston. In the case of state-of-the-art operating engines, the respective inlet valve is not opened in each work phase to increase the work volume.

In the state of the art (for a 4-stroke operating engine) a so-called intake cycle takes place. The inlet valve on the work volume is open during this intake cycle. The work volume fills with the medium.

Thereafter follows a work cycle with a reduction of the work volume. In the state-of-the-art operating engine both the inlet valve and the outlet valve on the work volume are closed at this time. The medium in the work volume is compressed. The mixture in the work volume is ignited shortly before the upper dead center is reached. This presses the piston downwards in the following work cycle to increase of the work volume. In this work cycle both the inlet valve and the outlet valve are closed. in the work cycle that then follows, the (combusted) mixture is pressed out of the work volume through the open outlet valve. Another intake cycle takes place subsequently A pressurized gas engine is known from DE 10 2008 010 359 A1. Gas can flow into a cylinder from a pressurized container through an inlet valve and a quick-action valve and move a piston. The gas can flow out of cylinder through an outlet valve.

A cylinder with a double piston is known from US 2012 0 096 845 A1, in which the cylinder is divided into two chambers.

According to the present invention the drive energy of the operating engine 527, 631, 832 results from the pressure with which the medium flows through the open inlet valve 516, 619, 819 or open inlet valves 516, 619, 819 that are allocated to the open inlet valve 516, 619, 819 or open inlet valves 516, 619, 819.

The present invention is a reciprocating piston engine 500, 600, 800 with double piston cylinders 525, 526, 626, 627, 825, 826 and double cylinders 503, 504, 611, 612, 812, 813, 814, 815 with double pistons 505, 507, 623, 628, 827, 828 that move inside the double cylinders 503, 504, 611, 612, 812, 813, 814, 815, whereby a secondary work volume 506, 508, 622, 831 of the double cylinder 503, 504, 611, 612, 812, 813, 814, 815 is connected to the work volume or one of the work volumes of the operating engine 527, 631, 832, and a primary work volume 511, 512, 613, 816 of the double cylinder 503, 504, 611, 612, 812, 813, 814, 815 includes the inlet valve 516, 619, 819 or inlet valves 516, 619, 819 and the outlet valve 517, 616, 820 or outlet valves 517, 616, 820.

The double piston cylinder 525, 526, 626, 627, 825, 826 is constructed in such a way that the double piston rod 513, 524, 614, 817, the double piston head 522, 523, 629, 630, 829, 830 and the double piston 505, 507, 302, 623, 628, 827, 828 itself are hollow inside. The double piston rod 513, 524, 614, 817 is open at the end where the piston is not attached, opposite the double piston head 522, 523, 629, 630, 829, 830.

The double piston 505, 507, 302, 623, 628, 827, 828 is sealed against the cylinder wall of the double cylinder 503, 504, 611, 612, 812, 813, 814, 815. The double piston rod 513, 524, 614, 817 is sealed against the wall at the end facing away from the double piston head 522, 523, 629, 630, 829, 830. The pressurized medium flows through this into the inside of the double piston 505, 507, 302, 623, 628, 827, 828 when the inlet valves 516, 619, 819 are open. The medium is thus pressed out of the inside of the double piston 505, 507, 302, 623, 628, 827, 828 and double piston rod 513, 524, 614, 817 when the outlet valves 517, 616, 820 are open. There is at least one air vent 532, 615, 818 or ventilation opening 532, 615, 818 in the primary work volume 511, 512, 613, 816 of the double piston 503, 504, 611, 612, 812, 813, 814, 815, which is enlarged through the movement of the double piston 503, 504, 611, 612, 812, 813, 814, 815 when the inlet valves 516, 619, 819 are open.

The inside of the double piston 503, 504, 611, 612, 812, 813, 814, 815 and the double piston rod 513, 524, 614, 817 are thus part of the primary work volume 511, 512, 613, 816 of the double cylinder 503, 504, 611, 612, 812, 813, 814, 815 in this embodiment.

If the double piston 503, 504, 611, 612, 812, 813, 814, 815 is moved when the inlet valves 516, 619, 819 are open, then air is taken in through these ventilation openings 532, 615, 818 so that no negative pressure is created against which the double piston 503, 504, 611, 612, 812, 813, 814, 815 needs to be moved. When the outlet valves 517, 616, 820 are open the movement of the double piston 503, 504, 611, 612, 812, 813, 814, 815 displaces the air again that was previously taken in, without the double piston 503, 504, 611, 612, 812, 813, 814, 815 having to compress this air during its movement.

A transmission ratio can be set when operating the operating engine 527, 631, 832 using the size of the volumes of the inside of the double piston 503, 504, 611, 612, 812, 813, 814, 815 and the double piston rod 513, 524, 614, 817 in comparison to the secondary work volume 506, 508, 622, 831 of the double cylinder 503, 504, 611, 612, 812, 813, 814, 815, which is equivalent to the working travel of the double piston 503, 504, 611, 612, 812, 813, 814, 815.

In the first working phase 518, 620, 823 of increasing the primary work volume 511, 512, 613, 816 or the respective primary work volumes 511, 512, 613, 816 the inlet valve 516, 619, 819 or inlet valves 516, 619, 819 allocated to the primary work volume 511, 512, 613, 816 or respective primary work volumes 511, 512, 613, 816 are open. The outlet valve 517, 616, 820 or outlet valves 517, 616, 820 allocated to the primary work volume 511, 512, 613, 816 or respective primary work volumes 511, 512, 613, 816 are closed at this time. In the present invention this occurs in each work cycle with an increase in work volume in a first working phase 518, 620, 823.

In the second working phase 519, 621, 824 of the reduction of the primary work volume 511, 512, 613, 816 or the respective primary work volumes 511, 512, 613, 816 the outlet valve 517, 616, 820 or outlet valves 517, 616, 820 allocated to the primary work volume 511, 512, 613, 816 or the respective primary work volumes 511, 512, 613, 816 are open. The inlet valve 516, 619, 819 or inlet valves 516, 619, 819 allocated to the primary work volume 511, 512, 613, 816 or respective work volumes 511, 512, 613, 816 are then closed. This takes place in the present invention in each second working phase 519, 621, 824 with a reduction in primary work volume 511, 512, 613, 816.

It is advantageous that this makes it possible to use the energy "contained" in the flow when using a flowing medium (for example with a body of water) without the need for combustion. This means that the operating materials are available at a low price, or even free of charge.

The operating engine 527, 631, 832 continues to deliver the performance using the present invention without producing exhaust gases from combustion.

In some embodiments of the present invention the operating engine 527, 631, 832 for the medium has a dual circuit arrangement, as illustrated in FIGS. 5-9. The dual circuit arrangement is created by having at least one double piston cylinder 525, 526, 626, 627, 825, 826 having a double cylinder 503, 504, 611, 612, 812, 813, 814, 815 with a double piston 503, 504, 611, 612, 812, 813, 814, 815. The secondary work volume 506, 508, 622, 831 of the double cylinder 503, 504, 611, 612, 812, 813, 814, 815 with the double piston 503, 504, 611, 612, 812, 813, 814, 815 is connected to the work volume or to one of the work volumes of the operating engine 527, 631, 832 via a main line 520, 521, 624, 625, 811, 901. The primary work volume 511, 512, 613, 816 of the double cylinder 503, 504, 611, 612, 812, 813, 814, 815 with the double piston 503, 504, 611, 612, 812, 813, 814, 815 includes both the inlet valve 516, 619, 819 or inlet valves 516, 619, 819 and the outlet valve 517, 616, 820 or outlet valves 517, 616, 820. It is advantageous if each work volume has one such double piston cylinder 525, 526, 626, 627, 825, 826.

The dual circuit arrangement is advantageous as there is no exchange of flowing material in the work volume of the operating engine 527, 631, 832. The exchange of medium in the work volumes of the operating engine 527, 631, 832, via the main line 520, 521, 624, 625, 811, 901, takes place with the secondary work volume 506, 508, 622, 831 of the double cylinder 503, 504, 611, 612, 812, 813, 814, 815. It is advantageous that this avoids contamination of the operating engine 527, 631, 832 as the medium flowing there is inert. The exchange with the flowing "foreign" medium takes place in the primary work volume 511, 512, 613, 816 of the respective double cylinder 503, 504, 611, 612, 812, 813, 814, 815. It proves to involve substantially less effort to exchange the double piston cylinders 525, 526, 626, 627, 825, 826 in the event of contamination or damage than to undertake repairs or cleaning work on the operating engine 527, 631, 832.

The opening and closing of the inlet valves 516, 619, 819 and outlet valves 517, 616, 820 can be carried out with a camshaft or through electronic control of the inlet valves 516, 619, 819 and outlet valves 517, 616, 820. The opening and closing of the inlet valves 516, 619, 819 and outlet valves 517, 616, 820 is synchronized with the work phases 10, 11, 305, 412, 411, 518, 519, 620, 621, 823, 824 of the primary work volumes 511, 512, 613, 816 (either increasing the work volume or decreasing the work volume).

DESCRIPTION OF THE DRAWINGS

One embodiment of the invention is shown in the figure. It shows.

DETAILED DESCRIPTION OF THE INVENTION

Figure 1:
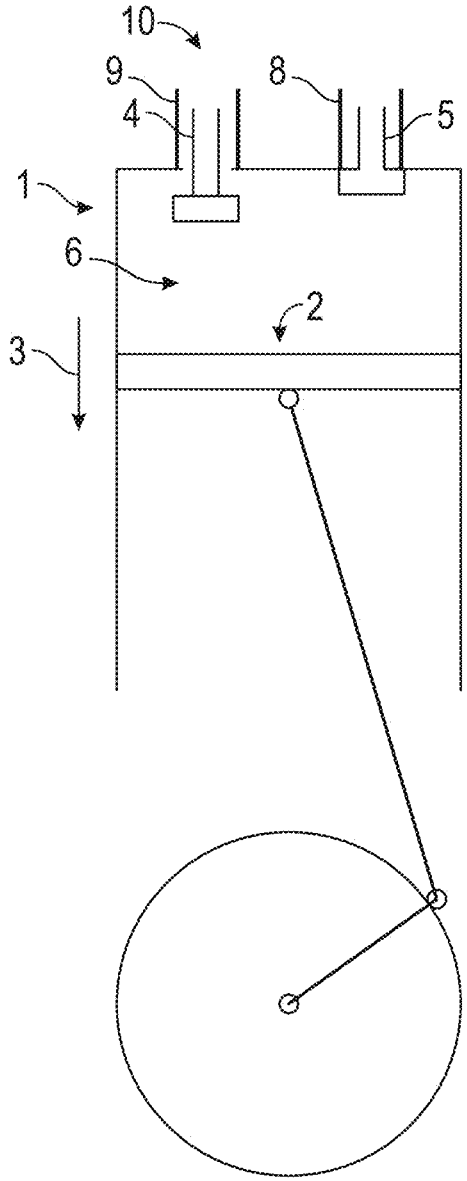
FIG. 1: A sectional view of a reciprocating piston in a known operating engine in the work phase of increasing the work volume.

FIG. 1 shows a sectional view of a cylinder 1 of an operating engine in the first working phase 10 of increasing the work volume 6. Piston 2 is shown (reciprocating piston) with the direction of movement (arrow 3) of piston 2. It can be seen that the inlet valve 4 is open in communication with the supply line 9. The outlet valve 5 is closed in communication with the discharge line 8.

Figure 2:
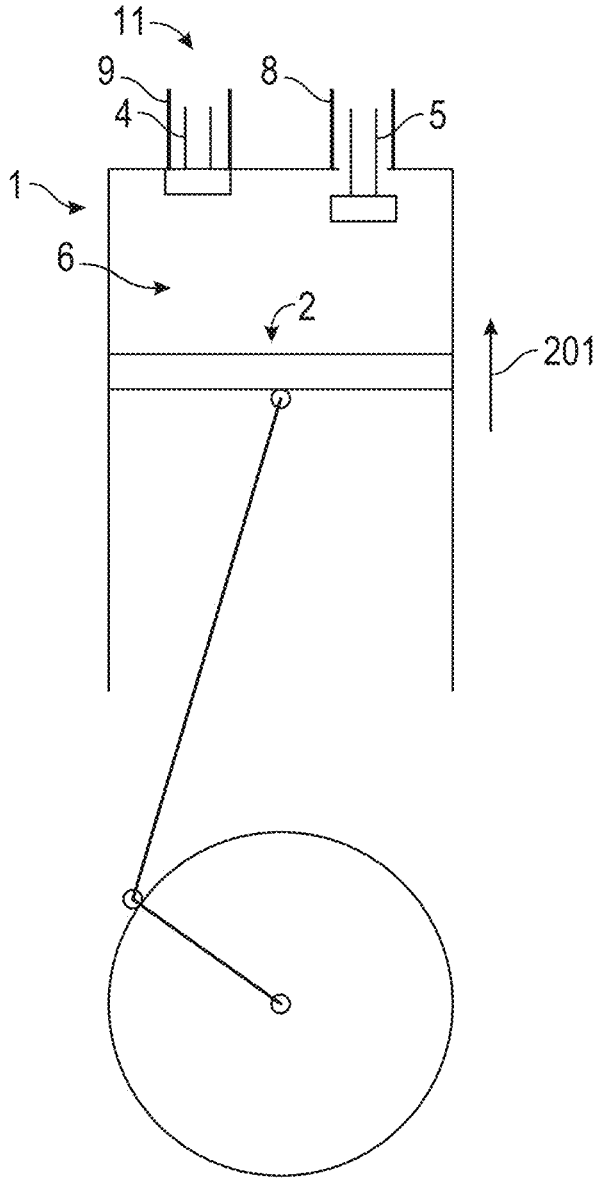
FIG. 2: a sectional view of a reciprocating piston in a known operating engine in the work phase of the reduction of the work volume.

FIG. 2 shows a sectional view of cylinder 1 according to the presentation in FIG. 1, but in the second working phase 11 of reducing the work volume 6. This is shown by arrow 201. It can be seen that the outlet valve 5 is opened in this work phase. Inlet valve 4 is closed.

Figure 3:
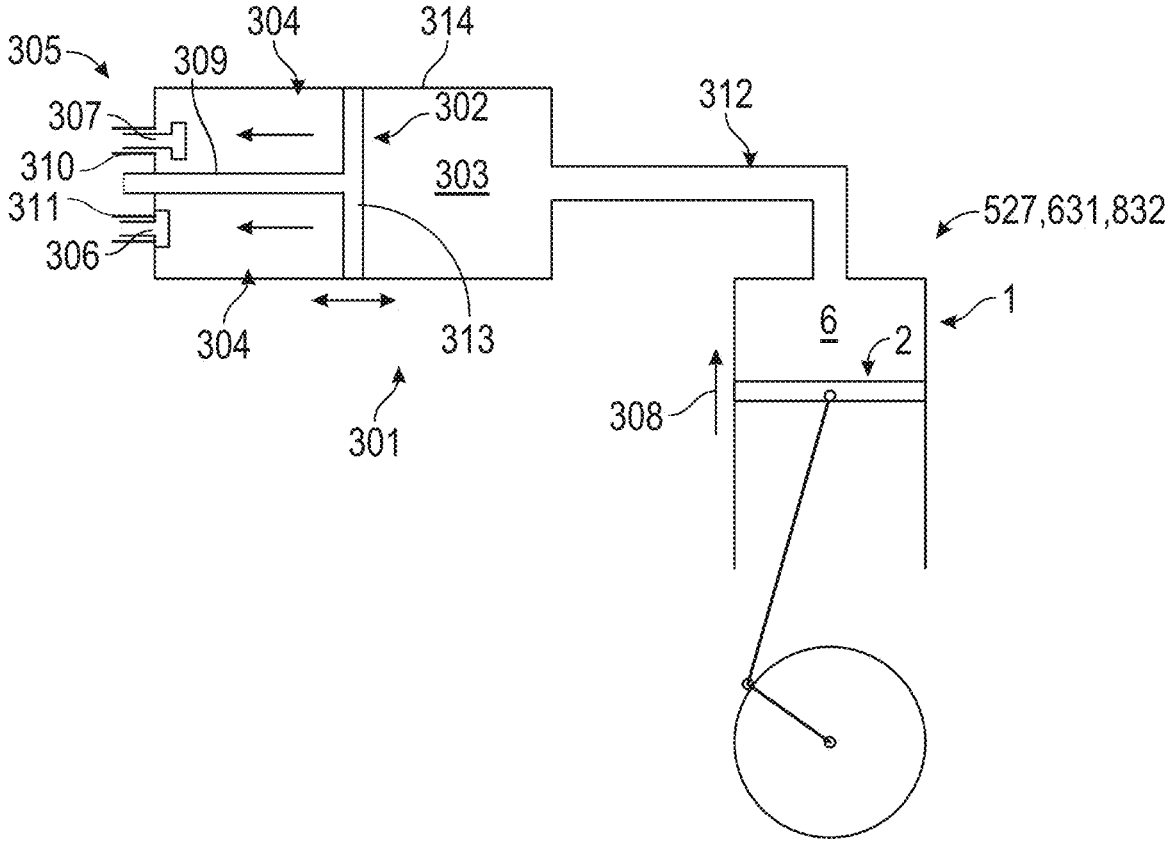
FIG. 3: a sectional view of a reciprocating piston in a known operating engine in a dual circuit arrangement of the operating engine.

FIG. 3 shows a sectional view of a cylinder 1 of an in a dual circuit arrangement of the medium for the operating engine 527, 631, 832. A double piston cylinder 301 can be seen including a double cylinder 314 and a double piston 302 that comprises a double piston head 313 and a double piston rod 309. The double piston 302 limits a secondary work volume 303 and a primary work volume 304 in the double piston cylinder 301. The secondary work volume 303 is connected to the work volume 6 of cylinder 1 via a main line 312.

Arrow 308 shows that reciprocating piston 2 moves upwards. This thus reduces the work volume 6 of cylinder 1. This thus increases the secondary work volume 303 of the double piston cylinder 301, referred to as a second working phase 305. An inlet valve 306 and an outlet valve 307 is allocated to the primary work volume 304 of the double piston cylinder 301 in communication with a supply line 311 and a discharge line 310, respectively. In the second working phase 305 represented here, the outlet valve 307 is opened and the inlet valve 306 is closed. This presses the medium out of the primary work volume 304 of the double piston cylinder 301.

In a first working phase of the increase of the work volume 6 of cylinder 1 the inlet valve 306 is opened and the outlet valve 307 closed. The secondary work volume 303 is reduced by the medium flowing into the primary work volume 304. This causes the medium in the secondary work volume 303 to flow into the work volume 6 of cylinder 1 and drives this.

Figure 4:
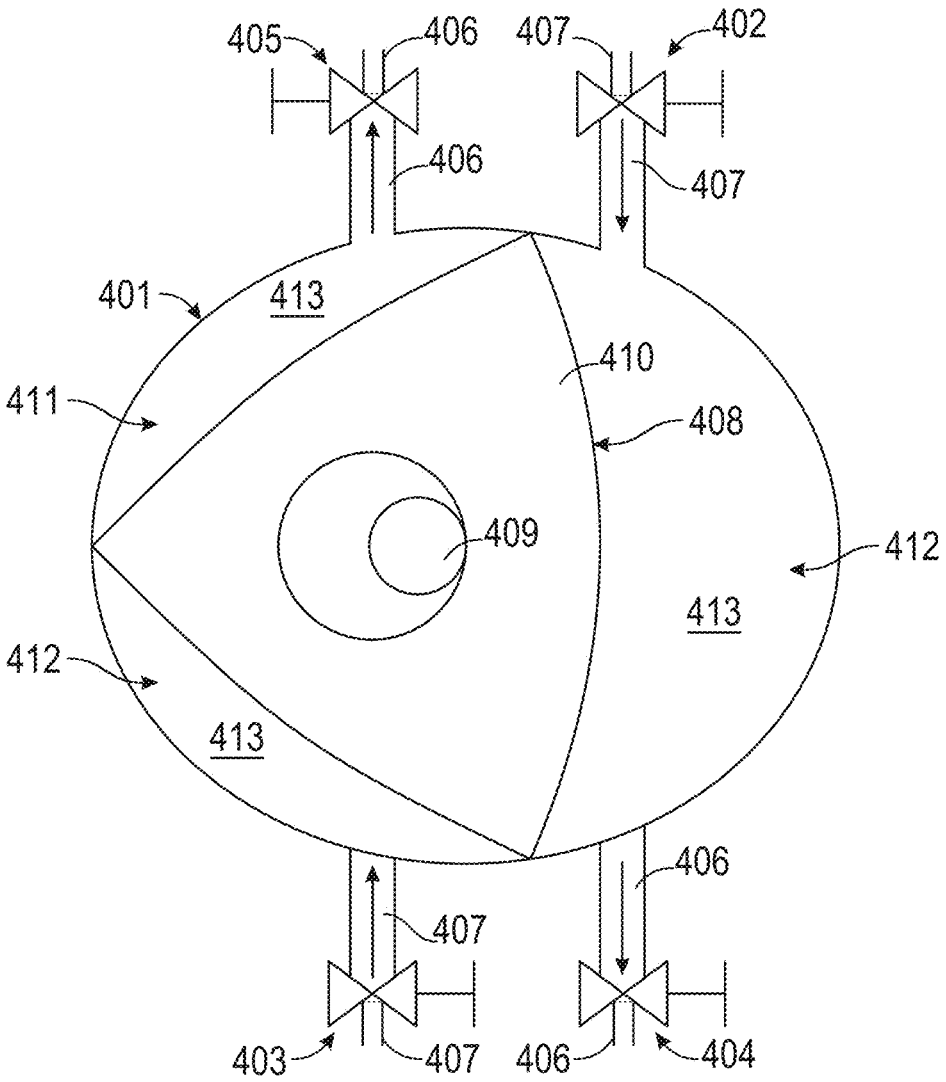
FIG. 4: a sectional view of a reciprocating piston in a known rotary piston machine.

FIG. 4 shows a sectional view of a rotary piston operating engine 401 that includes a rotary piston 408 comprising a rotary piston head 410 and a rotary piston rod 409. The inlet valves 402 and 403, supply lines 407, outlet valves 404 and 405, and discharge lines 406 can be seen. The inlet valves 402 and 403 and the outlet valves 404 and 405 are opened and closed according to the current position of the rotary piston 408 in such a way that the respective inlet valve 402, 403 is open, and the corresponding outlet valve 404, 405 is closed in a first working phase 412 of increasing the respective work volume 413. The corresponding outlet valve 404, 405 is open, and the corresponding inlet valve 402, 403 is closed in a second working phase 411 of reducing the respective work volume 413.

In the representation in FIG. 4 it can be seen that there is a further arrangement of inlet valves 402, 403 and outlet valves 404, 405 at the position of the rotary piston operating engine 401 where the spark plugs are usually located. This fills or empties the work volumes 413 so that the rotary piston 408, comprising a rotary piston head 410 and rotary piston rod 409, is driven by the flow pressure of the medium.

Figure 5:
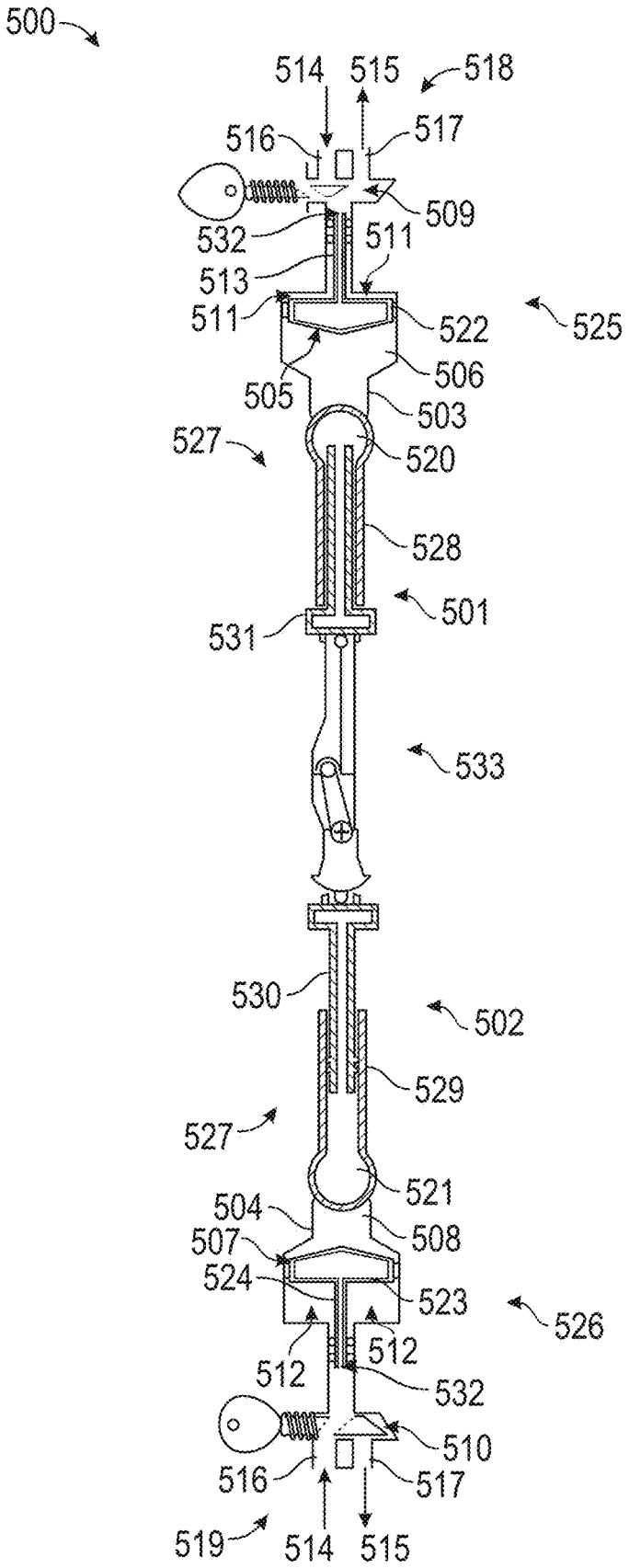
FIG. 5: a schematic representation of two co-operating cylinders with reciprocating pistons acting on a connecting rod.

FIG. 5 is a schematic representation of an operating engine 527 with two co-operating reciprocating piston cylinders 501 and 502 with two cylinders 528, 529 and reciprocating pistons 530, 531 acting on a connecting rod 533. The two reciprocating piston cylinders 501, 502 work as a dual circuit system with one double piston cylinder 525, 526 each. The main lines 520, 521 of the double piston cylinders 525 and 526 can be seen (labelled with the reference numbers 520 and 521), which lead to the individual double cylinders 503, 504 of the double piston cylinders 525, 526.

The double piston cylinder 525 has a double cylinder 503 and a double piston 505 that comprises a double piston rod 513 and a double piston head 522, which the double piston 505 is shown in the position at the stop at which the primary work volume 511 is minimal. The medium in the primary work volume 511 of this double cylinder 503 is pressed out completely through the valve 509 and discharge line 515.

This valve 509 is located at the position where the primary work volume 511 of this double cylinder 503 is connected with the main line 520, through which the medium is connected to cylinder 501 as well as further cylinders that are synchronized with cylinder 501 with regard to the power stroke.

The double piston cylinder 526 has a double cylinder 504 and a double piston 507 that comprises a double piston rod 524 and a double piston head 523, which is located at the stop in the position shown, where the primary work volume 512 is at a maximum. The primary work volume 512 of this double piston cylinder 526 is completely filled with the pressurized medium via the valve 510. This valve 510 is located in the position in which the primary work volume 512 of this double piston cylinder 526 is connected to the supply line 514. The secondary work volume 508 of the double cylinder 504 is connected with the main line 521, via which the medium is connected to the cylinder 502 and with further cylinders that are simultaneously synchronized with the cylinder 502 with respect to the work cycle.

The cylinders 501 and 502 are arranged in relation to each other according to the principle of a boxer engine, so that the work cycles of these cylinders 501 and 502 are simultaneously synchronized with one another.

In FIG. 5 it can be seen that in place of separate 2/2 valves for the inlet valves 516 and the outlet valves 517, 3/2 valves can also be provided (509 and 510), which alternately connect either the supply line arrangement 514 via the inlet valves 516 or the discharge line 515 arrangement via the outlet valves 517 to the primary work volume 511, 512 of the respective double piston cylinder 525, 526.

Figure 6:
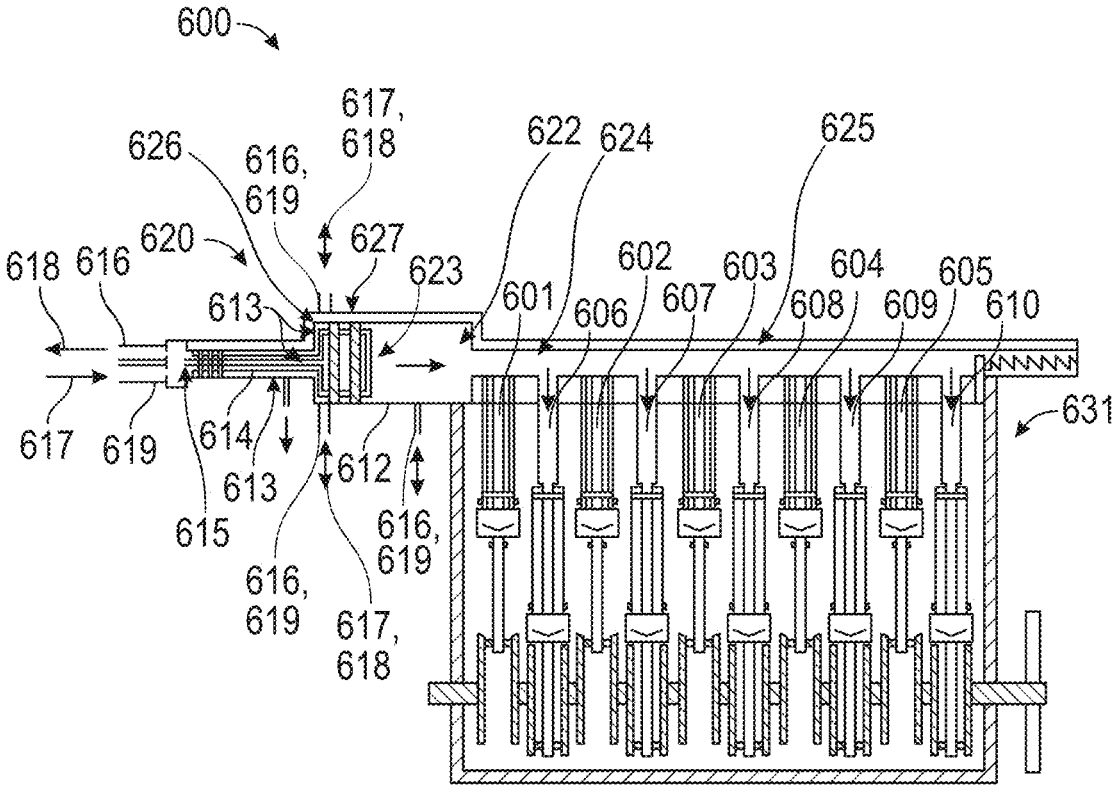
FIG. 6: a schematic representation of ten co-operating cylinders that are co-operating in two groups of five cylinders each with a double piston for each group.

FIG. 6 shows a schematic representation of ten co-operating cylinders 601, 602, 603, 604, 605 and 606, 607, 608, 609, 610, which work together in two groups: (601, 602, 603, 604, 605 designated as Group 1, and 606, 607, 608, 609, 610 designated as Group 2) of five cylinders each with one double piston per group. The double cylinder 611 is allocated to Group 1 and the double cylinder 612 to Group 2.

The cylinders 601, 602, 603, 604, 605 in Group 1 are simultaneously synchronized with one another. The cylinders 606, 607, 608, 609, 610 in Group 2 are also simultaneously synchronized with one another. The cylinders in Groups 1 and 2 are synchronized with one another in opposite directions.

In the embodiment example shown in FIG. 6 the primary work volume 613 of the double piston cylinder 626 is connected with the supply line 617, and the secondary work volume 622 is connected with the main line 624. The double piston cylinder 626 includes a double piston rod 614 and a double piston head 630. The double piston 623 on this double piston cylinder 626 is just at the point when the direction of movement of the double piston 623 changes from the second working phase 621 direction to reduce the primary work volume 613 to the direction of the first working phase 620 to increase the primary work volume 613. Correspondingly, the primary work volume 613 of the double piston cylinder 627 is just connected to the discharge line 618, with its secondary work volume 622 connected to main line 625.

Figure 7:
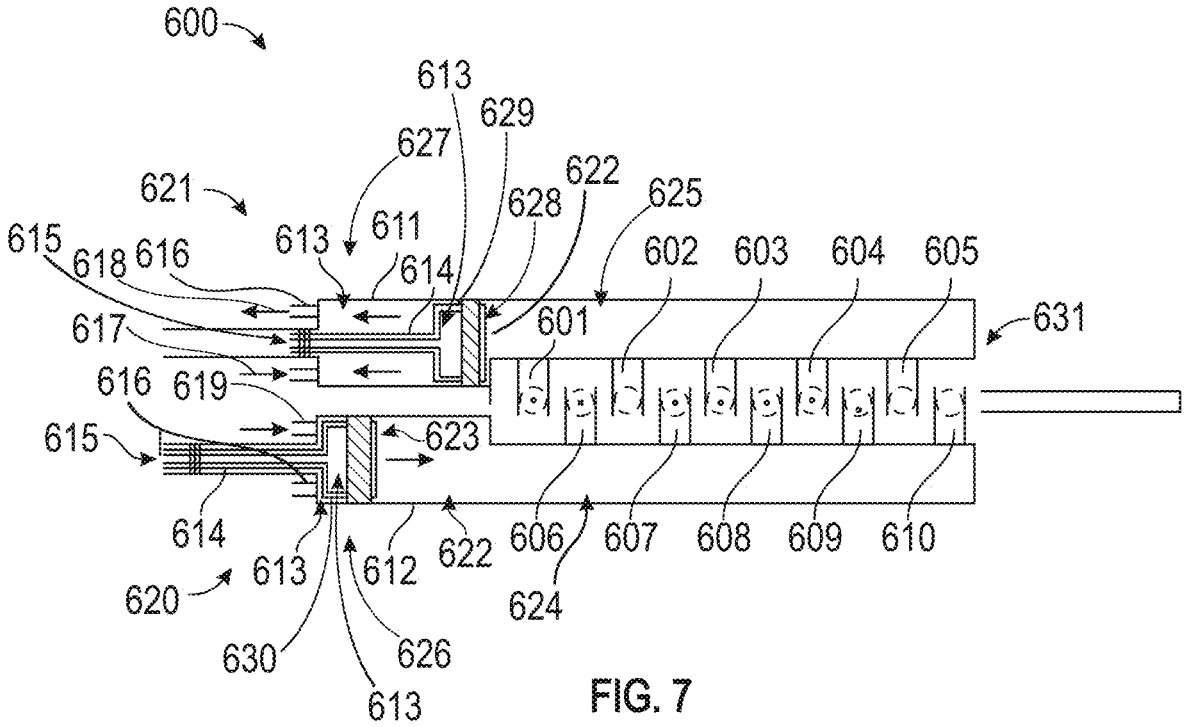
FIG. 7: the arrangement according to FIG. 6 in a top view from above.

FIG. 7 shows the arrangement according to FIG. 6 in a top view from above. The representation of FIG. 7 aims to explain the double piston 505, 507, 623, 628, 827, 828 that is used in the double piston cylinders 525, 526, 626, 627, 825, 826 in FIGS. 5 to 9. This double piston 505, 507, 623, 628, 827, 828 is constructed in such a way that the double piston rod 513, 524, 614, 817 and the double piston head 522, 523, 629, 630, 829, 830 are hollow. The double piston rod 513, 524, 614, 817 is open at the end to which the double piston rod 513, 524, 614, 817 is not attached. It can be seen that the double piston 505, 507, 623, 628, 827, 828 is sealed against the inner cylinder wall of the double cylinder 503, 504, 611, 612, 812, 813, 814, 815. Also, the double piston rod 513, 524, 614, 817 is sealed against the wall in the area of the end facing away from the double piston 505, 507, 623, 628, 827, 828/double piston head 522, 523, 629, 630, 829, 830.

The pressurized medium thus flows into the inside of the double piston 505, 507, 623, 628, 827, 828 when the inlet valves 516, 619, 819 are opened. If the outlet valves 517, 616, 820 are opened, this medium is pressed from the inside of the double piston 505, 507, 623, 628, 827, 828 and the double piston rod 513, 524, 614, 817. The inside of the double piston head 522, 523, 629, 630, 829, 830 and the double piston rod 513, 524, 614, 817 are thus part of the primary work volume 511, 512, 613, 816 of the double piston cylinder 525, 526, 626, 627, 825, 826 in this embodiment. It can be seen that there is at least one air vent 532, 615, 818 or ventilation opening 532, 615, 818 in the primary work volume 511, 512, 613, 816 of the double piston 505, 507, 623, 628, 827, 828 that exists "behind" the double piston 505, 507, 623, 628, 827, 828 through the movement of the double piston 505, 507, 623, 628, 827, 828 when the inlet valves 516, 619, 819 are open. If the double piston 505, 507, 623, 628, 827, 828 is moved when the inlet valves 516, 619, 819 are open, then air is taken in through these ventilation openings 615, so that no negative pressure is created, against which the double piston 505, 507, 623, 628, 827, 828 needs to be moved. When the outlet valves 517, 616, 820 are opened the movement of the double piston 505, 507, 623, 628, 827, 828 causes the air that was taken in previously to be displaced from the double cylinder 611, 612 without the double piston 505, 507, 623, 628, 827, 828 needing to compress this air during its movement.

A transmission ratio can be set when operating the operating engine via the size of the volumes 613 of the inside of the double piston 623, 628, double piston head 629, 630, and the double piston rod 513, 524, 614, 817 in comparison to the secondary work volume 622 of the double piston cylinder, which is equivalent to the working travel of the double piston 623, 628.

In an embodiment of the double piston cylinder 301 and the double piston 302 in accordance with FIG. 3 the double piston 302, double piston head 313, and double piston rod 309 are solid. The primary work volume 304 of the double cylinder 314 consists of the double piston 302 being displaced "into the secondary work volume 303". This double piston cylinder 301 has a transmission ratio of 1:1.

In principle, the use of a double piston cylinder 301 as shown in FIG. 3 is possible in all embodiments, as well as in accordance with the explanations in connection with FIG. 7.

Figure 8:
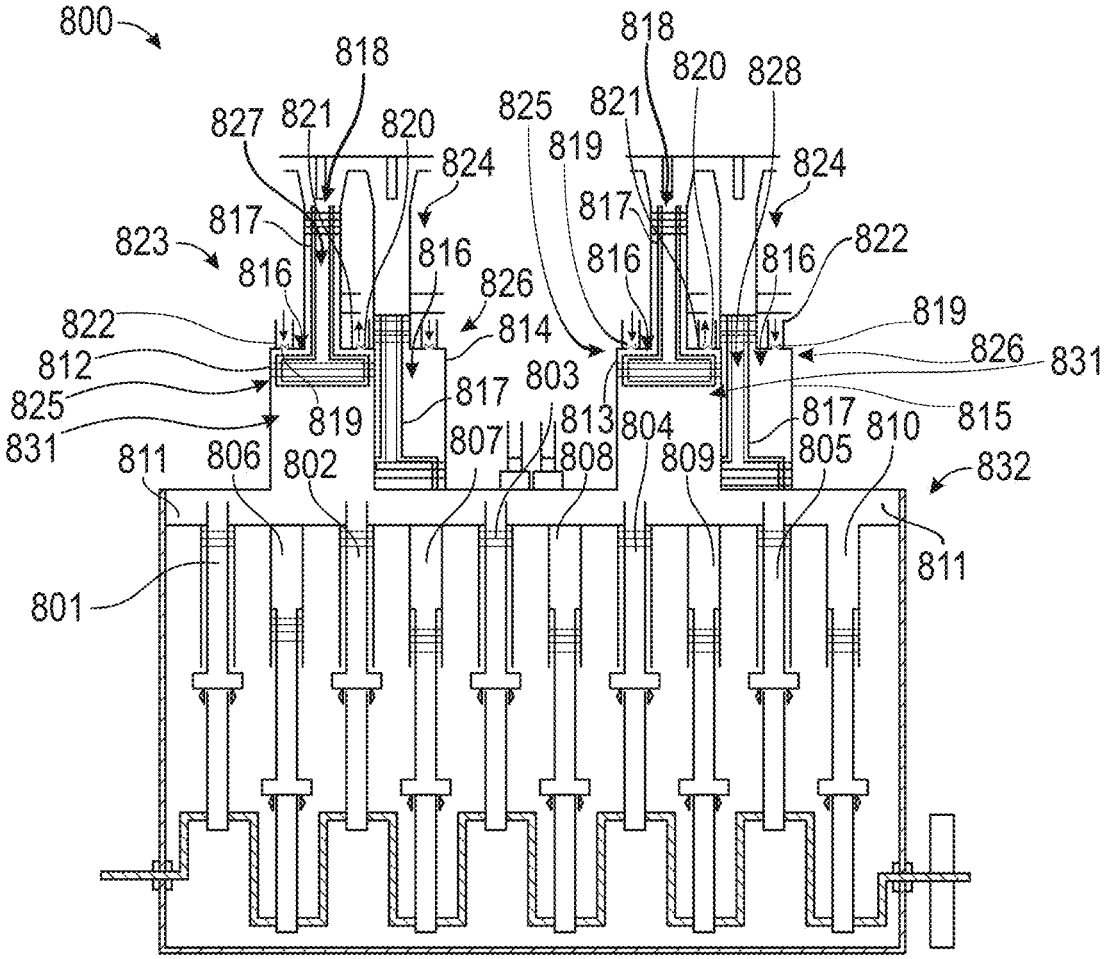
FIG. 8: a schematic representation of an arrangement of ten co-operating cylinders that are co-operating in two groups of five cylinders each with a different construction of the double cylinder.

FIG. 8 shows a schematic representation of an arrangement of ten co-operating cylinders 801, 802, 803, 804, 805 and 806, 807, 808, 809, 810, in two groups (801, 802, 803, 804, 805 designated as Group 1; 806, 807, 808, 809, 810 designated as Group 2) with five cylinders with one double piston cylinder 812, 813, 814, 815 per group, with a different construction compared to the representation in FIG. 6.

The double piston cylinders 825 have respective primary work volumes 816 that are allocated to the main line 811, which is connected to the cylinders 801, 802, 803, 804 and 805. Similar to the above embodiments, each double piston cylinder 825 includes an inlet 819, a supply line 821, an outlet 820, a discharge line 821, a double cylinder 812, 813, and a double piston 827 comprising a double piston head 829 and a double piston rod 817.

The double piston cylinders 826 have respective primary work volumes 816 that are connected to a main line 901, which is connected to the cylinders 806, 807, 808, 809 and 810. The main line 901 is hidden by main line 811 in the representation of FIG. 8. Each double piston cylinder 826 includes an inlet 819, a supply line 822, an outlet 820, a discharge line 821, a double cylinder 814, 815 and a double piston 826 comprising a double piston head 828 and a double piston rod 817.

Figure 9:
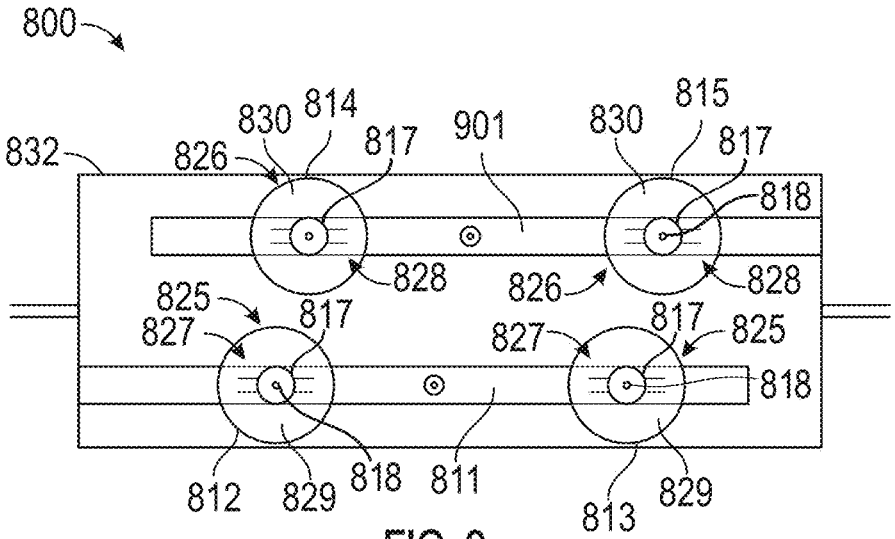
FIG. 9: the arrangement according to FIG. 8 in a top view from above.

FIG. 9 shows the arrangement according to FIG. 8 in a top view from above. In this representation the main line 901 can be seen.

What is claimed is:

1. A working engine comprising:

at least one double cylinder;

a respective double piston that is movable within the at least one double cylinder;

a respective primary working volume defined by the at least one double cylinder and the respective double piston;

a respective secondary working volume defined by the at least one double cylinder and the respective double piston, wherein the respective secondary working volume is connected to at least one working volume of a group of co-operating cylinders of an operating engine via a main line;

at least one inlet valve associated with the respective primary working volume; and at least one outlet valve associated with the respective primary working volume;

wherein the at least one inlet valve is connected to a supply line arrangement that a medium is fed therethrough;

wherein the at least one inlet valve is arranged such that when the at least one inlet valve is open, the medium is supplied to the associated respective primary working volume;

wherein the at least one outlet valve comprises a respective discharge line arrangement that the medium is dischargeable therethrough;

wherein the at least one outlet valve is arranged such that when the at least one outlet valve is open the medium from the respective at least one primary working volume is discharged via the discharge line arrangement;

wherein when the at least one inlet valve and the at least one outlet valve are in a first working phase to increase the respective primary working volume and increase the at least one working volume of the group of co-operating cylinders, the at least one inlet valve is open and the at least one outlet valve is closed;

wherein when the at least one inlet valve and the at least one outlet valve are in a second working phase to reduce the respective primary working volume and reduce the at least one working volume of the group of co-operating cylinders, the at least one outlet valve is open and the at least one inlet valve is closed;

wherein a drive energy results from a pressure caused by the medium flowing into the respective primary working volume via the at least one inlet valve;

wherein the respective double piston includes a double piston head and a double piston rod;

wherein a first end of the double piston rod is connected to the double piston head, and a second end of the double piston rod has an opening;

wherein the respective double piston, the double piston head, and the double piston rod are hollow;

wherein the double piston head is sealed against a cylinder wall of the at least one double cylinders;

wherein the second end of the double piston rod is sealed against the cylinder wall of the at least one double cylinder;

wherein the medium flows into the respective double piston when the at least one inlet valve is open;

wherein the medium is pressed out of the respective double piston when the at least one outlet valve is open; and wherein the respective double piston comprises at least one air ventilation opening.

2. The working engine according to claim 1, further comprising a dual-circuit arrangement that comprises at least one secondary double cylinder having a respective secondary double piston; wherein a respective secondary working volume of the at least one secondary double cylinder is connected to the at least one secondary working volume of a secondary group of co-operating cylinders of the operating engine; and wherein a respective primary working volume of the at least one secondary double cylinder is associated with at least one secondary inlet valve and at least one secondary outlet valve.

* * * * *